United States Patent [19]

Veitenhansl et al.

[11] Patent Number: 4,883,604

[45] Date of Patent: Nov. 28, 1989

[54] SMOOTHING COMPOSITIONS FOR TEXTILE FIBERS CONTAINING DIALKYL ETHERS OF (POLY)ALKYLENE GLYCOLS

[75] Inventors: Rudolf Veitenhansl, Haan; Peter Waltenberger, Breitscheid-Hollig; Fritz Lange, Essen; Guenter Uphues, Monheim; Uwe Ploog, Haan, all of Fed. Rep. of Germany

[73] Assignee: Henkel Kommanditgesellschaft auf Aktien, Duesseldorf, Fed. Rep. of Germany

[21] Appl. No.: 159,621

[22] Filed: Feb. 23, 1988

[30] Foreign Application Priority Data

Oct. 15, 1987 [DE] Fed. Rep. of Germany ..... 3734931

[51] Int. Cl.[4] ..... D06M 13/02; D06M 13/18; D06M 13/46

[52] U.S. Cl. ..... 252/8.9; 252/8.6; 252/8.8; 428/375; 428/378; 428/392; 428/395; 428/396

[58] Field of Search ..... 252/8.9, 8.6; 428/375, 428/378, 392, 395, 396

[56] References Cited

U.S. PATENT DOCUMENTS 4,474,668 10/1984 Petzold et al. ..... 252/8.6

FOREIGN PATENT DOCUMENTS 3541535 5/1987 Fed. Rep. of Germany .
51-15095 2/1976 Japan .

*Primary Examiner*—Dennis Albrecht
*Assistant Examiner*—Kathlene Markowski
*Attorney, Agent, or Firm*—Ernest G. Szoke; Wayne C. Jaeschke; Real J. Grandmaison

[57] ABSTRACT

The invention relates to compositions and methods for smoothing textile fibers which compositions are characterized in that they contain as lubricants an aliphatic polyether corresponding to the following general formula:

$$R^1—X—O—R^2$$

in which $R^1$ and $R^2$ are linear and/or branched, saturated and/or saturated, OH-containing or OH-free $C_6$–$C_{24}$ alkyl radicals of natural and/or synthetic origin and X is a homopolymer or copolymer containing one or more $C_2$–$C_6$ alkylene oxides having a degree of polymerization of 1 to 25, either alone or in admixture with other smoothing agents.

The other smoothing agents include paraffins, polyethylenes, fatty acid ethers, silicones or polyalkylene glycols. The compositions may be applied to textile fiber in the form of solutions, emulsions or aqueous dispersions.

15 Claims, No Drawings

SMOOTHING COMPOSITIONS FOR TEXTILE FIBERS CONTAINING DIALKYL ETHERS OF (POLY)ALKYLENE GLYCOLS

This is a continuation of co-pending application Ser. No. 860,499 filed on May 7, 1986, which is a continuation of Ser. No. 715,203, filed on Mar. 25, 1985, now U.S. Pat. No. 4,712,674.

BACKGROUND OF THE INVENTION

This invention relates to preparations for smoothing textile fibers, to a process for smoothing textile fibers and to the use of aliphatic polyethers as smoothing agents. This application is related to commonly assigned copending application Ser. No. 159,628, filed on even date herewith.

The combined effect of higher offwinding speeds for yarns and filaments and distinctive and refined techniques for the manufacture of sheet-form textiles has been that the travel characteristics of yarns used in the modern textile industry must meet increasingly stringent requirements. To satisfy these requirements, smoothing and flexibilizing substances have to be applied to the yarns and to the sheet-form materials produced from them to improve their further processing properties. The terms "smoothing agent", "smoothing substance", and "smoothing composition" as used herein mean materials which impart the property of slipperiness to fibers to which they are applied.

The smoothing agents used are required on the one hand to reduce friction both between the individual fibers and between fibers or yarns and metal and, on the other hand, to guarantee satisfactory stitchability of sheet-form textiles. If excessive friction is generated during stitching, stitching damage occurs through filaments being damaged, broken or overheated. The consequences of stitching damage are particularly serious in the case of knitted fabrics because laddering can later occur upon mechanical stressing of the fabric. For this reason, the mobility of the filaments in the stitch network is also of great importance. Reducing the needle penetration forces during sewing on modern high-speed sewing machines has acquired particular significance because high-speed sewing machines operating purely mechanically can make up to 7,000 stitches per minute. However, this requires more vibration-resistant and hence thicker needles which again can easily cause stitch damage.

Paraffins, esters, polyethylenes, silicones and polyalkylene glycols are known smoothing agents as for example disclosed in the publication "Melliand Textilberichte", Vol. 3, pp. 203 to 207 (1977). The effectiveness of these smoothing agents in many cases depends on the nature of the fiber substrate. U.S. Pat. No. 4,474,668 describes polyethylenes as smoothing agents for textile fibers having an average molecular weight of from 3,000 to 8,000, a density of from 0.94 to 1.01, an acid value of from 25 to 60 and a saponification value of from 40 to 80.

SUMMARY OF THE INVENTION

The object of the present invention is to develop smoothing agents which, by comparison with known smoothing agents, bring about a considerable improvement, i.e., a reduction in the friction between individual fibers and between fibers and metal, and a distinct reduction in the needle penetration forces, the effectiveness of which is not dependent on the nature of the fiber substrate.

Earlier German patent application No. P 37 06 362.6 (the counterpart of the co-pending U.S. patent application referred to above) describes dialkyl ethers as smoothing agents. These agents bring about a distinct reduction in the friction between individual fibers and between fibers and metal and a distinct reduction in the needle penetration forces. It has now surprisingly been found that textile fibers treated with aliphatic polyethers corresponding to the following general formula:

$$R^1—X—O—R^2$$

in which $R^1$ and $R^2$ are linear and/or branched, saturated and/or unsaturated, OH-containing or OH-free $C_6$–$C_{24}$ alkyl radicals of natural and/or synthetic origin and X is a homopolymer or copolymer containing one or more $C_2$–$C_6$ alkylene oxides having a degree of polymerization of 1 to 25, exhibit greatly reduced friction coefficients and distinctly reduced needle penetration forces.

Accordingly, the present invention relates to compositions for smoothing textile fibers in the form of solutions, emulsions or dispersions which are characterized in that they contain aliphatic polyethers corresponding to the following general formula:

$$R^1—X—O—R^2$$

in which $R^1$ and $R^2$ are linear and/or branched, saturated and/or unsaturated, OH-containing or OH-free $C_6$–$C_{24}$ alkyl radicals of natural and/or synthetic origin and X is a homopolymer or copolymer containing one or more $C_2$–$C_6$ alkylene oxides having a degree of polymerization of 1 to 25, used either alone or in combination with other smoothing agents.

The present invention also relates to a process for smoothing textile fibers which is characterized in that textile fibers are smoothed with preparations containing aliphatic polyethers corresponding to the following general formula:

$$R^1X—O—R^2$$

in which $R^1$ and $R^2$ are linear and/or branched, saturated and/or unsaturated, OH-containing or OH-free $C_6$–$C_{24}$ alkyl radicals of natural and/or synthetic origin and X is a homopolymer or copolymer containing one or more $C_2$–$C_6$ alkylene oxides having a degree of polymerization of 1 to 25, used either alone or in combination with other smoothing agents.

The present invention also relates to the use of aliphatic polyethers corresponding to the following general formula:

$$R^1—X—O—R^2$$

in which $R^1$ and $R^2$ are linear and/or branched, saturated and/or unsaturated, OH-containing or OH-free $C_6C_{24}$ alkyl radicals of natural and/or synthetic origin and X is a homopolymer or copolymer containing one or more $C_2$–$C_6$ alkylene oxides having a degree of polymerization of 1 to 25, used either alone or in combination with other smoothing agents as smoothing agents for textile fibers.

In the context of the invention, the term "alkyl" stands for alkyl and/or alkenyl radicals.

DETAILED DESCRIPTION OF THE INVENTON

The smoothing preparations according to the invention in its preferred embodiment contain aliphatic polyethers corresponding to the following general formula:

$$R^1—X—O—R^2$$

in which $R^1$ and $R^2$ are $C_8$–$C_{22}$ alkyl groups and X is a homopolymer or copolymer containing one or more Chd 2–$C_4$ alkylene oxides having a degree of polymerization of 1 to 12. Particularly preferred are aliphatic polyesters corresponding to the above general formula in which $R^1$ and $R^2$ are $C_{12}$–$C_{18}$ alkyl groups and X is ethylene oxide having a degree of polymerization of 1 to 6. Tallow alkyl.2 ethylene oxide (EO) tallow alkyl ether, tallow alkyl.1EO-tallow alkyl ether, tallow alkyl.5EO-tallow alkyl ether, dodecyl.2EO-tallow alkyl ether and tallow alkyl.5EO-stearyl ether are examples of particularly preferred aliphatic polyethers.

The aliphatic polyethers according to the invention are prepared in known manner, for example by reaction of the alkoxylated, for example ethoxylated and/or propoxylated, $C_6$–$C_{24}$ alkyl alcohols in the form of their alkali salts with alkali salts of $C_6$–$C_{24}$ alkyl sulfates at temperatures of 130° to 200° C.

The aliphatic polyethers are used either as a sole smoothing agent component or in admixture with other smoothing agents. The smoothing agents which may be admixed are preferably paraffins having softening points of from 35° to 80° C., polyethylenes, for example the oxidized polyethylene waxes described in U.S. Pat. No. 4,474,668; fatty acid esters containing from 8 to 22 carbon atoms in the fatty acid part and from 1 to 22 carbon atoms in the alcohol part such as palmitic acid methyl ester, stearyl stearate, behenyl behenate and isotridecyl stearate; silicones such as dimethyl polysiloxane; and polyalkylene glycols, for example polyethylene glycols having average molecular weights of from 600 to 2000. In smoothing agent mixtures, the ratio by weight of dialkyl ether to admixed smoothing agents is preferably from 10:1 to 1:4 and more preferably from 4:1 to 1:1.

The smoothing agents according to the invention may be applied to textile fibers in the form of solutions, emulsions or dispersions. They may be applied from water or from organic solvents, for example aliphatic and/or aromatic hydrocarbons such as gasoline, cyclohexane, toluene, xylene, or halogenated, preferably chlorinated, hydrocarbons such as methylene chloride and perchloroethylene. The content of smoothing agent in solutions is from 5 to 10% by weight and in emulsions and dispersions, from 5 to 30% by weight. The smoothing agents according to the invention are preferably applied to fibers in the form of aqueous dispersions. In the context of the invention, the term "textile fibers" means natural fibers such as cotton, wool, synthetic wool, and mixtures thereof, or synthetic fibers such as polyacrylonitrile, polyester, polyamide, triacetate, polyethylene, polypropylene, and mixtures thereof, as well as mixtures of natural and synthetic fibers. The textile fibers may be present as flock, combed slivers, knitting yarn, weaving yarn, sewing yarn, knitted fabrics, woven fabrics or nonwovens and preferably as knitting yarn, weaving yarn, sewing yarn knitted fabrics or woven fabrics. The material may be gray, i.e., unbleached, bleached or dyed. The yarns may be both filament yarns and also fiber yarns.

The aqueous dispersions containing the smoothing agents according to the invention are prepared in known manner either by mixing all the components at 80° to 170° C. or by melting all the components except the water and then adding water, optionally under pressure, at 80° to 170° C. However, the melt may also be added to water at 80° to 100° C. The finely divided aqueous dispersions formed have solids contents of from 5 to 40% by weight and pH values of from 3.5 to 11.

The smoothing agents according to the invention are applied to the textile fibers by means of standard machines, such as cheese, hank or muff dyeing machines, winch vats or spin dyeing machines. Application by an extraction process, for example a drawing process, from a dye bath or rinsing bath takes place from an aqueous liquor with a liquor ratio of from 1:2 to 1:40 and a pH value in the liquor of from 2 to 8 at temperatures of from 25° to 80° C. and at a concentration, based on the weight of the fabric, of from 0.2 to 3.0 and preferably from 0.2 to 2.5% by weight of smoothing agent. The smoothing agents according to the invention may also be applied to the textile fibers by a forced application process, for example by padding, centrifugal immersion, godet application, by metering pumps, of the type commonly used in the production of synthetic filament yarns, or by spraying. Application by padding is carried out with a concentration (expressed as 100% active substance) of from 1 to 50 g/l liquor and preferably from 5 to 20 g/l liquor, optionally in the presence of finishes, such as crease-resistant or shrinkage-resistant finishes.

In addition to the reduction in friction between individual fibers and between fibers and metal and the reduction in the needle penetration forces, fabric and/or fiber auxiliaries are also required to exhibit further properties. For example, they should cause very little, if any, yellowing, should be stable to shear forces, should have a softening effect, should not foam significantly, if at all, and should be heat-stable. To satisfy these requirements, the smoothing agents according to the invention, which are preferably present in the form of aqueous dispersions, may be mixed with softening agents and other additives such as anti-oxidants, foam inhibitors, stabilizers, antistatic agents, preservatives, pH regulators and/or perfumes.

Fabric and/or fiber auxiliary smoothing compositions according to the invention preferably contain:

from 5 to 30% by weight aliphatic polyethers, alone or in admixture with paraffins, polyethylenes, fatty acid esters, silicones or polyalkylene glycols;

from 1 to 20% by weight of dispersants;

from 0 to 15% by weight of softeners;

from 0 to 6% by weight of one or more other additives including antioxidants, foam inhibitors, stabilizers, antistatic agents, preservatives, pH regulators and/or fragrances; and water to make 100% by weight.

The smoothing agents according to the invention, which are preferably present in the form of aqueous dispersions, may be dispersed in water by known methods using nonionic, cationic, anionic and/or amphoteric dispersants. Suitable nonionic dispersants include alkoxylated, preferably ethoxylated and/or propoxylated fats, oils, fatty alcohols containing from 8 to 24 carbon atoms in the fatty part, fatty amines containing from 8 to 24 carbon atoms in the fatty part and $C_8$–$C_{18}$ alkylphenols such as castor oil containing 25 ethylene oxide units, tallow alcohol containing 5 ethylene oxide units, tallow alcohol containing 20 ethylene oxide units, $C_{12}$–$C_{18}$ coconut oil alcohol containing 10 ethylene oxide units and nonylphenol containing 10 ethylene oxide units. The fatty amines may contain from 2 to 10 ethylene oxide units. Suitable cationic dispersants include alkoxylated, preferably ethoxylated and/or propoxylated, $C_{10}$–$C_{22}$ alkylamines in the form of their ammonium salts such as stearylamine containing 10 moles ethylene oxide. Suitable anionic dispersants include alkali metal and/or ammonium salts of $C_6$–$C_{24}$ fatty acids, $C_8$–$C_{22}$ alkyl and/or $C_8$–$C_{22}$ alkyl ether sulfates, $C_8$–$C_{22}$ alkyl and/or $C_8$–$C_{22}$ alkylbenzenesulfonates, $C_8$–$C_{22}$ alkyl and/or $C_8$–$C_{22}$ alkylbenzenesulfosuccinates and $C_8$–$C_{22}$ alkyl and/or $C_8$–$C_{22}$ alkyl ether phosphates. Suitable amphoteric dispersants include $C_8$–$C_{22}$ alkyl dimethyl betaines, N—$C_8$–$C_{22}$ alkylamidobetaines and amphoteric surfactants derived from amino acids.

The softening component added to the fabric and/or fiber auxiliaries which contain the smoothing agents according to the invention may be fatty acid amidopolyamines preferably obtained from saturated $C_{16}$–$C_{22}$ fatty acids or $C_{16}$–$C_{22}$ fatty acid mixtures and esters thereof and polyalkylene polyamines, such as diethylenetriamine, triethylene-tetramine, tetraethylenepentamine or aminoethyl ethanolamine, the reaction being carried out in such a molar ratio that amine nitrogen atoms capable of salt formation remain intact. The fatty acid amidopolyamines are present in the form of their salts, preferably with lower carboxylic acids or hydroxycarboxylic acids containing from 1 to 4 carbon atoms, for example acetic acid or glycolic acid. According to the invention, inorganic acids are also suitable for the formation of fatty acid amidopolyamine salts. Examples of such acids are hydrohalic acids such as hydrochloric acid; oxyacids of phosphorus such as orthophosphoric acid, phosphorous and hydrophosphorous acid; oxyacids of sulfur such as sulfuric acid and sulfurous acid; as well as boric acid and phosphonic acids.

Quaternary ammonium salts, such as lauryl trimethylammonium chloride, dodecyl benzyltrimethyl ammonium methosulfate, dimethyl distearyl ammonium chloride and/or 3-ethyl-i-hydroxyethyl-2-heptadecyl imidazolinium ethyl sulfate, are also suitable as softeners in fabric and/or fiber auxiliaries containing smoothing agents according to the invention. Mono- and/or diethanolamides, such as tallow fatty acid diethanolamide, may also be present as softening constituents in the smoothing compositions according to the invention.

Fabric and/or fiber auxiliaries which contain smoothing agents according to the invention may contain from 0 to 0.5% by weight antioxidants, for example oxyacids of phosphorus, such as phosphorous and hypophosphorous acid, or alkali disulfites; from 0 to 1.0% by weight of a silicone-based foam inhibitor; from 0 to 1.0% by weight of a stabilizer; such as starch derivatives and gum arabic; from 0 to 5% by weight of an antistatic agent such as alkoxylated, preferably ethoxylated and/or propoxylated, $C_6$–$C_{24}$ fatty amines; from 0 to 0.05% by weight preservatives, for example formaldehyde; pH regulators, for example a $C_1$–$C_4$ carboxylic acid and/or $C_1$–$C_4$ hydroxycarboxylic acid such as acetic acid or glycolic acid; alkali hydroxides such as potassium hydroxide; and aminoalcohols such as 2-diethyl aminoethanol; and 0 to 0.1% by weight fragrances. Preferably some or all of these components are present in the aqueous dispersions up to the maximum levels specified above.

The textile fibers treated with the smoothing preparations according to the invention show distinctly lower friction values and greatly reduced stitching forces, irrespective of the method by which the smoothing preparations are applied to the fibers. The smoothing preparations according to the invention show high thermal stability in the production of high-strength filament yarns and are color-stable and non-volatile under thermal stressing, for example during drying or fixing.

EXAMPLE 1

This example describes the preparation of 3 different stable aqueous dispersions (A to C) containing various smoothing agents according to the invention. EO represents ethylene oxide units.

| | | | |
|---|---|---|---|
| (A) | 115.5 | g | tallow alkyl.2 EO - tallow alkyl ether prepared by reaction of tallow alcohol. 2 EO with tallow alkylsulfate, sodium salt |
| | 38.5 | g | oxidized high-density (HD) polyethylene (average molecular weight 4500, acid value (a. val.) = 30) |
| | 4.5 | g | 2-diethylaminoethanol |
| | 6.7 | g | tallow alcohol.5 EO |
| | 13.3 | g | tallow alcohol.20 EO |
| | 20.0 | g | $C_{12}$–$C_{18}$ coconut oil alcohol.10 EO |
| | 0.6 | g | sodium disulfite |
| | 600.9 | g | water |

The above starting materials were heated with stirring for 1 hour at 155° to 160° C. in a bucket autoclave.After cooling, 800 g of a finely divided dispersion having a pH value of 9.1 were obtained.

| | | | |
|---|---|---|---|
| (B) | 100.0 | g | tallow alkyl.5 EO - stearyl ether prepared by reaction of tallow alcohol. 5 EO with stearyl chloride |
| | 54.0 | g | oxidized HD polyethylene as in A |
| | 4.8 | g | potassium hydroxide, 45% |
| | 20.0 | g | $C_{12}$–$C_{18}$ coconut oil alcohol.10 EO |
| | 20.0 | g | nonylphenol.10 EO |
| | 0.8 | g | sodium disulfite |
| | 600.4 | g | water |

800 g of a finely divided dispersion having a pH value of 9.8 were prepared from the above starting materials by the method described in A.

| | | | |
|---|---|---|---|
| (C) | 100.0 | g | dodecyl.2 EO tallow alkyl ether prepared by reaction of dodecyl alcohol .2 EO with tallow alkyl sulfate, sodium salt |
| | 54.0 | g | oxidized HD polyethylene as in A |
| | 4.8 | g | potassium hydroxide, 45% |
| | 20.0 | g | $C_{12}$–$C_{18}$ coconut oil alcohol.10 EO |
| | 20.0 | g | nonylphenol.10 EO |
| | 0.8 | g | sodium disulfite |
| | 600.4 | g | water |

800 g of a finely divided dispersion having a pH value of 9.5 were prepared from the above starting materials by the method described in A.

EXAMPLE 2

This example describes the formulation of 3 different stable aqueous dispersions (D to F) which do not contain smoothing agents of the present invention, but contain other smoothing agents known in the art.

| | | | |
|---|---|---|---|
| | 200.0 | g | low-density (LD) polyethylene (average molecular weight 1650, a. val. 26, melting point 98–102° C.) |
| | 55.0 | g | tallow amine.10 EO |
| | 6.3 | g | acetic acid, 10% |
| | 750.0 | g | water |
| (E) | 179.5 | g | HD polyethylene (average molecular weight 4700, a.val. 29, melting point 130–140°) |
| | 20.8 | g | glycolic acid, 70% |
| | 53.7 | g | tallow amine.2 EO |
| | 3.1 | g | sodium disulfite |
| | 742.9 | g | water |
| (F) | 180.0 | g | Paraffinum durum (melting point 52–54°) |
| | 120.0 | g | isotridecyl stearate |
| | 2.4 | g | stearyl alcohol.20 EO |
| | 48.0 | g | fatty acid amidopolyamine based on behenic/stearic acid and tetraethylene pentamine; $N_{titr.}$ = 3.2% |
| | 9.6 | g | coconut fatty acid polydiethanolamide |
| | 48.0 | g | acetic acid, 60% |
| | 592.0 | g | water |

EXAMPLE 3

100% cotton yarn made up as a compact package was dyed in a high-temperature short-liquor dyeing machine. The yarns were dyed with reactive dyes, soaped and after treated to improve the wet fastness values. The subsequent smoothing treatment was carried out from a fresh bath in acetic acid medium over a period of 20 minutes at 50° C. and at a pH value of 5.5. The aqueous dispersions containing the smoothing agents according to the invention present in A, B and C, and the other smoothing agents present in D, E and F were used for smoothing, 0.6% by weight active substance being applied in each case. The yarns were dried in a pressure dryer.

The coefficients of friction My were determined on a Schlafhorst friction balance and are shown in Table 1.

TABLE 1

| Aqueous dispersion containing smoothing agent | Coefficient of friction (My value) Cn yarn*, count 60/1 |
|---|---|
| A according to the invention | 0.15 |
| B according to the invention | 0.17 |
| C according to the invention | 0.16 |
| D prior art | 0.25 |
| D prior art | 0.20 |
| F prior art | 0.21 |

*Note: Cn yarn is cotton yarn.

EXAMPLE 4

Cn/PES knitted fabric was dyed with reactive and dispersion dyes in a laboratory spin-dyeing machine. Smoothing was carried out from a fresh bath over a period of 20 minutes at 45° C. and at a pH value of 6 using aqueous dispersions containing smoothing agents A, B or C according to the invention or the other smoothing agents, D. E or F, 0.5% by weight active substance being applied in each case. The fabric samples were dried in a tumbler dryer.

The needle penetration forces of a Pfaff type 483 industrial sewing machine with a built-in penetration force recorder, 4,000 stitches per minute, were measured as a measure of stitchability. The average values from 50 individual stitches are shown in Table 2.

TABLE 2

| Aqueous dispersion containing smoothing agent | Needle penetration forces in cN Cn/PES knitted fabrics* |
|---|---|
| A according to the invention | 150 |
| B according to the invention | 194 |
| C according to the invention | 174 |
| D prior art | 327 |
| E prior art | 264 |
| F prior art | 253 |

Note: Cn/PES is cotton/polyester.

EXAMPLE 5

A cotton knitted fabric was finished in a padding machine using 50 g/l liquor Stabitex® FRD, Henkel KGaA (dimethylol dihydroxyethylene urea) and 5.0 g/l liquor magnesium chloride as catalyst. The sample fabrics were then shock-condensed for 30 seconds at 175° C. on a tenter frame. To improve stitchability and feel, 50 g/l liquor of each of the aqueous dispersions containing smoothing agents A, B and C according to the invention and the other smoothing agents D, E and F were added to the liquors. The squeezing effect on the padding machine was around 80%.

The needle penetration forces in cN were determined as in Example 4 and are shown in Table 3.

TABLE 3

| Aqueous dispersion containing smoothing agent | Needle penetration forces in cN Cn knitted fabric |
|---|---|
| A according to the invention | 261 |
| B according to the invention | 285 |
| C according to the invention | 270 |
| D prior art | 430 |
| E prior art | 328 |
| F prior art | 346 |

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

We claim:

1. A liquid composition for treating fibers to impart the property of slipperiness to the fibers consisting essentially of from about 5 to about 30% by weight of a smoothing agent containing an aliphatic polyether having the formula:

$$R^1—X—O—R^2$$

wherein $R^1$ and $R^2$ are selected from a hydroxy substituted or non-hydroxy substituted alkyl or alkenyl group having from 6 to 24 carbon atoms, each of $R^1$ and $R^2$ being the same or different, and X is a homopolymer of copolymer containing one or more $C_2$ to $C_6$ alkylene oxide groups having a degree of polymerization of 1 to 25, said composition being in the form of a solution, dispersion or emulsion in water or an organic solvent and oxidized, high-density polyethylene wherein the weight ratio of aliphatic polyether to said polyethylene is within the range of about 10:1 to about 1:4, respectively.

2. The composition of claim 1 wherein the $R^1$ and $R^2$ groups contain from 8 to 22 carbon atoms and X is a homopolymer or copolymer containing one or more $C_2$ to $C_4$ alkylene oxide groups having a degree of polymerization of 1 to 12.

3. The composition of claim 1 wherein the $R^1$ and $R^2$ groups contain 11 to 18 carbon atoms and X has a degree of polymerization of 1 to 6.

4. The composition of claim 1 wherein the weight ratio of aliphatic polyether to said polyethylene is within the range of about 4:1 to about 1:1 respectively.

5. The composition of claim 1 wherein said aliphatic polyether is selected from the group consisting of tallow alkyl-2 ethylene oxide-tallow alkyl ether, tallow alkyl-1 ethylene oxide-tallow alkyl ether, tallow alkyl-5 ethylene oxide-tallow alkyl ether, dodecyl-2 ethylene oxide-tallow alkyl ether and tallow alkyl-5 ethylene oxide-stearyl ether.

6. The composition of claim 1 in the form of an aqueous dispersion.

7. A process for smoothing textile fibers consisting essentially of contacting said fibers with the composition of claim 1, and drying said fibers, said composition being applied at a weight sufficient to lower the coefficient of friction of said fibers.

8. Textile fibers produced by the process of claim 7.

9. An aqueous dispersion for smoothing textile fibers to impart the property of slipperiness to the fibers consisting essentially of:

a. from about 5 to about 30% by weight of a smoothing agent containing an aliphatic polyether having the formula:

$$R^1—X—O—R^2$$

wherein $R^1$ and $R^2$ are selected from a hydroxy substituted or non-hydroxy substituted alkyl or alkenyl group having from 6 to 24 carbon atoms, each of $R^1$ and $R^2$ being the same or different, and X is a homopolymer or copolymer containing one or more $C_2$ to $C_6$ alkylene oxide groups having a degree of polymerization of 1 to 25, and oxidized, high-density polyethylene wherein the weight ratio of aliphatic polyether to said polyethylene is within the range of about 10:1 to about 1:4, respectively, b. from about 1 to about 20% by weight of a dispersant selected from a nonionic, cationic, anionic and amphoteric surfactant; and c. water to make 100% by weight.

10. The dispersion of claim 9 wherein the $R^1$ and $R^2$ groups contain 8 to 22 carbon atoms and X is a homopolymer or copolymer containing one or more $C_2$ to $C_4$ ethylene oxide groups having a degree of polymerization of 1 to 6.

11. The dispersion of claim 10 wherein the weight ratio of aliphatic polyether to said polyethylene is within the range of about 4:1 to about 1:1 respectively.

12. The dispersion of claim 9 further containing a fabric softener at a level not greater than about 15% by weight.

13. The dispersion of claim 12 further containing one or more textile fiber auxiliary additives selected from an antioxidant, a foam inhibitor, a stabilizer, an antistatic agent, a preservative, a pH regulator and a fragrance.

14. A process for smoothing textile fibers consisting essentially of contacting said fibers with the composition of claim 9, and drying said fibers, said composition being applied at a weight sufficient to lower the coefficient or friction of said fibers.

15. Textile fibers produced by the process of claim 14.

* * * * *